US007962070B2

(12) United States Patent
Takeshita et al.

(10) Patent No.: US 7,962,070 B2
(45) Date of Patent: Jun. 14, 2011

(54) REPLENISHER DEVELOPER CARTRIDGE, AND METHOD OF ADJUSTING REPLENISHER DEVELOPER CARTRIDGE

(75) Inventors: Haruo Takeshita, Tokyo (JP); Kiyotaka Naito, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/698,607

(22) Filed: Feb. 2, 2010

(65) Prior Publication Data

US 2010/0202802 A1 Aug. 12, 2010

(30) Foreign Application Priority Data

Feb. 10, 2009 (JP) ..... 2009-028171

(51) Int. Cl.
*G03G 15/08* (2006.01)

(52) U.S. Cl. ..... 399/258

(58) Field of Classification Search ..... 399/255, 399/258, 259, 261, 262; 347/140; 147/120.1, 147/122.1

See application file for complete search history.

(56) References Cited

U.S. PATENT DOCUMENTS

| | | | | |
|---|---|---|---|---|
| 4,589,762 | A * | 5/1986 | De Schamphelaere et al. | 399/58 |
| 5,604,576 | A * | 2/1997 | Inoue et al. | 399/255 |
| 6,017,116 | A * | 1/2000 | Larson | 347/55 |
| 2006/0140679 | A1 * | 6/2006 | Iwata et al. | 399/254 |
| 2007/0238041 | A1 * | 10/2007 | Kobayashi et al. | 430/108.1 |
| 2007/0269235 | A1 * | 11/2007 | Hirose | 399/254 |
| 2007/0280742 | A1 * | 12/2007 | Matsumoto et al. | 399/258 |

FOREIGN PATENT DOCUMENTS

| | | |
|---|---|---|
| JP | 11223960 | 8/1999 |
| JP | 2002351142 | 12/2002 |
| JP | 2004029306 | 1/2004 |

* cited by examiner

*Primary Examiner* — David P Porta
*Assistant Examiner* — Marcus H Taningco
(74) *Attorney, Agent, or Firm* — Lucas & Mercanti, LLP

(57) ABSTRACT

Provided is a replenisher developer cartridge for a trickle developing system image forming apparatus producing no image problem such as image density unevenness, image roughness or the like. Not only an image forming apparatus by which high quality images are stably output, and a replenisher developer cartridge for the image forming apparatus were possible to be provided, but also durability of a two-component developer used in the image forming apparatus was possible to be improved, by replenishing the image forming apparatus with a replenisher developer in the carrier concentration range of 5-30% by weight in terms of the mean value, and in the carrier concentration deviation range of 10% by weight or less, based on the replenisher developer.

11 Claims, 12 Drawing Sheets

REPLENISHER DEVELOPER CARTRIDGE, AND METHOD OF ADJUSTING REPLENISHER DEVELOPER CARTRIDGE

This application claims priority from Japanese Patent Application No. 2009-028171 filed on Feb. 10, 2009, which is incorporated hereinto by reference.

TECHNICAL FIELD

The present invention relates to a trickle developing system image forming apparatus by which developing is conducted while replenishing a replenisher developer composed of a toner and a carrier, when an electrostatic latent image is developed with the toner by a two-component developing system, and also to a replenisher developer cartridge for the trickle developing system image forming apparatus and a method of adjusting the replenisher developer cartridge.

BACKGROUND

In the field of POD (Print On Demand) or shortrun printing, continuous print preparation of several thousand print sheets is to be estimated, since print preparation scale thereof is much larger than that of office use. In such the printing case, stability obtained via no variation of image quality from beginning to end has been demanded. Further, in this field, there was also an opportunity to prepare print sheets in which a great variety of information was included, and toner consumption was often changed largely with variation in picture element ratio of the image during print preparation.

In the case of full-color image formation, image formation by a two-component developing system employing a developer composed of a toner and a carrier is widely utilized, but the two-component developer capable of enduring ling-term use has been demanded in order to stably provide full-color images with excellent image quality.

In the two-component developing system, the toner is appropriately charged via friction of the toner with the carrier surface, but when developing is repeatedly conducted over a long period of time, a resin layer provided on the carrier surface is peeled because of the friction, and toner constituents adhere to the carrier surface, whereby charging ability of the carrier is gradually lowered. As the result, there appeared a problem such that developing performance to supply the predetermined amount of toner from the carrier to a photoreceptor was degraded, whereby image density was varied, and specifically, the desired color balance was difficult to be obtained in full-color image formation.

Further, also in the case of continuous print preparation of several thousand print sheets, demanded has been print preparation performance so as to suppress and minimize change in image density and hue of all the print sheets printed from beginning to end.

Consequently, proposed is an image forming apparatus equipped with a so-called trickle developing system developing device by which a replenisher developer, in which a small amount of new carrier is mixed with a new toner, is supplied from a replenishing developer container to a developing device, and charging ability of the carrier is maintained by gradually replacing in-use carrier with the new carrier (refer to Patent Documents 1 and 2, for example). The technique disclosed in Patent Document 1 relates to a color image forming apparatus equipped with a trickle developing system developing device by which a replenisher developer prepared via mixture so as to make the carrier concentration to be about 3% to about 50% is supplied.

The technique disclosed in Patent Document 2 is one by which three kinds of replenisher developers in which each of three kinds of carriers having different resistance is prepared with the toner are stored by dividing an area into three regions in the longitudinal direction of a developer container, and a new carrier having different resistance is sequentially supplied as toner replenishing time passes.

In view of a long-term outlook, the ability decline of carrier can be inhibited by replenishing the degraded carrier with a new carrier. On the other hand, the carrier concentration (a ratio of carrier weight to replenisher developer weight) of a replenisher developer sequentially replenished momentarily from the developer container to the inside of the developing device is not stable, and largely varied.

For this reason, there appeared a problem such that toner supply performance of the developer supplied onto a developing roller facing a latent image on a photoreceptor was largely varied, and difference in performance was produced at the position of the developing roller, whereby image density unevenness at solid density image portions, or image roughness at halftone image portions was generated.

(Patent Document 1) Japanese Patent O.P.I. Publication No. 11-223960

(Patent Document 2) Japanese Patent O.P.I. Publication No. 2004-29306

SUMMARY

It is an object of the present invention to provide a replenisher developer cartridge for an image forming apparatus of a trickle developing system by which image quality problems such as image density unevenness and image roughness are not produced, and also to provide a method of adjusting the replenisher developer cartridge.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which.

DESCRIPTION OF THE PREFERRED EMBODIMENTS

Figure 1:
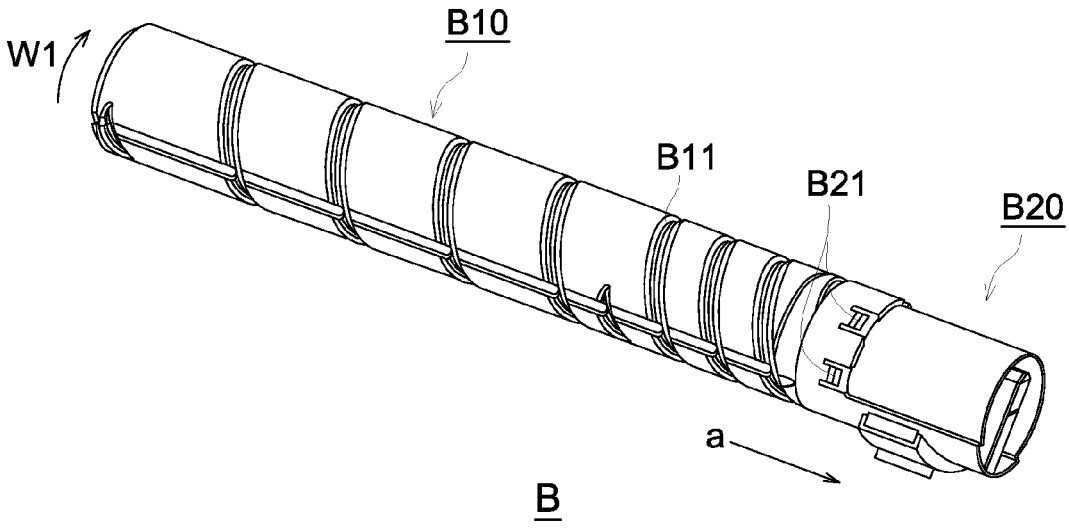
FIG. 1 is an appearance perspective view showing developer container B in which a replenisher developer is stored.

The above object of the present invention is accomplished by the following structures.

(Structure 1) A replenisher developer cartridge to replenish an image forming apparatus comprising a two-component developing device with a replenisher developer comprising a toner and a carrier, stored in a developer container, wherein the carrier in the replenisher developer has a concentration of 5-30% by weight in terms of mean value, and a concentration deviation of the carrier in the replenisher developer is 10% by weight or less.

(Structure 2) The replenisher developer cartridge of Structure 1, wherein the carrier in the replenisher developer has a concentration of 5-20% by weight in terms of mean value.

(Structure 3) The replenisher developer cartridge of Structure 1, wherein the replenisher developer cartridge is capable of being put on the image forming apparatus when developing is conducted.

(Structure 4) The replenisher developer cartridge of Structure 1, wherein the replenisher developer cartridge is adjusted by filling the toner and the carrier in the developer container so as to place a carrier layer on top of a toner layer and, shaking the developer container by vibrational energy.

(Structure 5) The replenisher developer cartridge of Structure 4, wherein the vibrational energy is applied to the developer container by contacting a shaking device on an outer wall surface of the developer container and operating the shaking device in order to vibrate itself.

(Structure 6) The replenisher developer cartridge of Structure 4, wherein the vibrational energy is applied to the developer container by contacting at least a first shaking device and a second shaking device on an outer wall surface of the developer container in a direction where the toner layer and the carrier layer are piled up in the developer container, wherein the first shaking device is placed on the carrier layer side and the second shaking device is placed on the toner layer side, and the second shaking device is operated after operating the first shaking device.

(Structure 7) The replenisher developer cartridge of Structure 6, wherein the second shaking device is operated after completion of the operating the first shaking device.

(Structure 8) A method of adjusting a replenisher developer cartridge, the replenisher developer cartridge being for replenishing to an image forming apparatus having a two-component developing device with a replenisher developer stored in a developer container comprising a toner and a carrier, and the method comprising the steps of filling the toner and the carrier in the developer container so as to place a carrier layer on top of a toner layer and, shaking the developer container by vibrational energy.

(Structure 9) The method of adjusting a replenisher developer cartridge of Structure 8, wherein the vibrational energy is applied to the developer container by contacting a shaking device on an outer wall surface of the developer container and operating the shaking device in order to vibrate itself.

(Structure 10) The method of adjusting a replenisher developer cartridge of Structure 9, wherein the vibrational energy is applied to the developer container by contacting at least a first shaking device and a second shaking device on an outer wall surface of the developer container in a direction where the toner layer and the carrier layer are piled up in the developer container, wherein the first shaking device is placed on the carrier layer side and the second shaking device is placed on the toner layer side, and the second shaking device is operated after operating the first shaking device.

(Structure 11) The method of adjusting a replenisher developer cartridge of Structure 10, wherein the second shaking device is operated after completion of the operating the first shaking device.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, embodiments of the present invention will now be described. In addition, the technological scope of claims and significance of terms are not limited by the description herein. Further, the following definitive description in the embodiments of the present invention indicates the typical mode, but significance of terms and technological scope in the present invention are not limited.

[Development Container]

FIG. 1 shows an appearance perspective view of developer container B in the embodiment of the present invention as a container in which a replenisher developer is stored.

The replenisher developer is mainly composed of a toner as the first particle and a carrier as the second particle. Developer container B in which the replenisher developer is stored is composed of cylindrical container main body B10 and cap B20.

Toner stored in container main body B10 is sealed with cap B20, and the toner discharged from container main body B10 is discharged into a developing device installed in an image forming apparatus. Cap B20 is prepared via plastic injection molding.

In the situation where developer container B is installed in an image forming apparatus (not shown in the figure), container main body B10 rotates in the W1 direction shown in the figure, but cap B20 remains unmoved.

The toner in container main body B10 is moved in the direction of cap B20 via propulsive action of spiral protrusion B11 during rotation in the W1 direction, and discharged into the developing device installed in the image forming apparatus from an unshown outlet placed in cap B20.

Cap B20 can be removed from container main body B10 by pulling container main body BID in the direction of arrow a in the situation where a plurality of locking claws 21 provided to cap B20 have been displaced outward.

Figure 2:
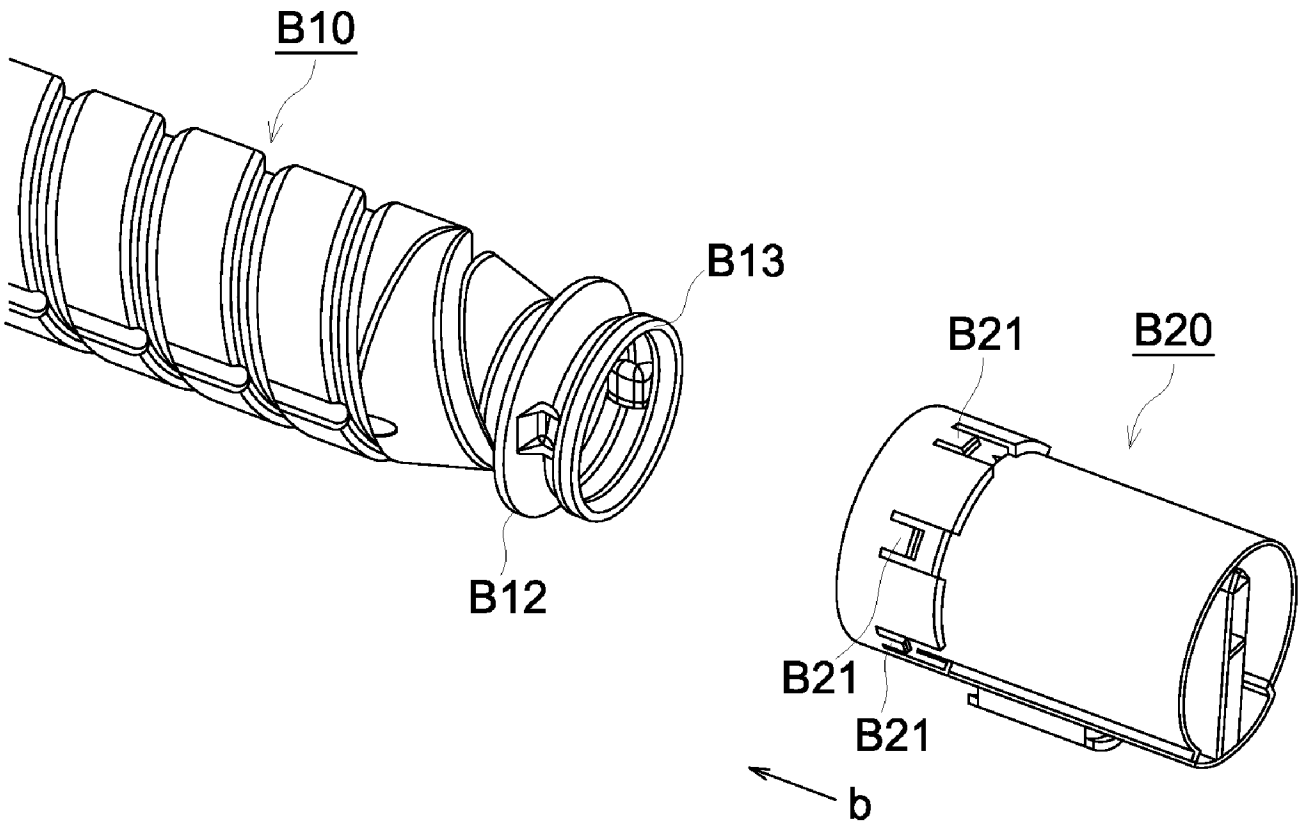
FIG. 2 is an appearance perspective view showing developer container B in the situation where cap B20 is detached from container main body B10.

FIG. 2 is an appearance perspective view showing developer container B in the situation where cap B20 is detached from container main body B10.

In the situation where cap B20 is attached onto container main body B10 in the direction of arrow a, locking claw 21 of cap B20 locks ring-shaped protrusion B12 of container main body B10 to avoid removal of cap B20 from container main body B10.

In addition, sealing member B13 to prevent leakage of the replenisher developer is provided at the opening of container main body B10 to seal the spacing between container main body B10 and cap B20.

[Formulation of Replenisher Developer]

The replenisher developer described above is composed of a toner and a carrier, and external additives are attached on the toner particle surface. Employed were the same toner and carrier as those constituting a developer fitted with a developing device installed in an image forming apparatus from the beginning. Adjustment of the replenisher developer is carried out by mixing the toner and the carrier.

<Formulation of Toner>

The toner is a particle in which a colorant particle is dispersed in a resin of styreneacrylic polymer, prepared by a method of manufacturing a toner particle dispersion via emulsion polymerization disclosed in Japanese Patent O.P.I. Publication No. 2002-351142, and the particle diameter is 4-7 μm.

The toner has a specific gravity of 1.05.

The addition amount of external additives is 0.5 parts by weight, based on the above-described toner.

<Carrier>

The carrier possesses a magnetic core material and a resin coating layer coated on the surface of the magnetic core material.

As the magnetic core material, a ferrite material with lightweight and strong magnetic force is used. The particle diameter is 30 μm in terms of average weight thereof.

The resin coating layer is made of an acrylic acid ester polymer as a thermoplastic resin.

The carrier has a specific gravity of 3.50, which is larger than that of the toner.

<External Additive>

External additives are composed of hydrophobic silica particles (commercially available product R-805, produced by Nippon Aerosil Co., Ltd.).

Adjusting Apparatus of Replenisher Developer

The First Embodiment

FIGS. 3*a*-3*e* each are a general outline diagram showing a principle of an adjusting apparatus to adjust a replenisher developer for a trickle developing system.

Figure 3A:
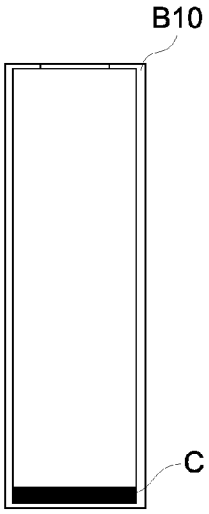
FIGS. 3*a*-3*e* each are a general outline diagram showing a principle of an adjusting method and an adjusting apparatus in the first embodiment.

The first step is a step to charge a predetermined amount of carrier C into container main body B10 from the opening. FIG. 3*a* shows a situation after conducting the first step. The predetermined amount of the carrier indicates the total amount of carrier filled in developer container B.

Figure 3B:
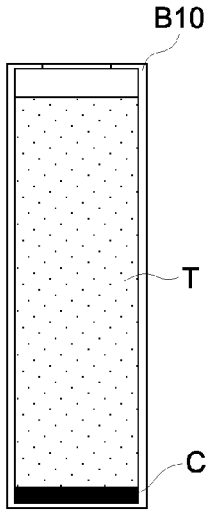

The second step is a step to form a deposition layer of toner T on the carrier C layer by charging the predetermined amount of toner T in container main body in the situation of FIG. 3*a*. FIG. 3*b* shows a situation after conducting the second step. The predetermined amount of the toner indicates the total amount of toner filled in developer container B.

Figure 3C:
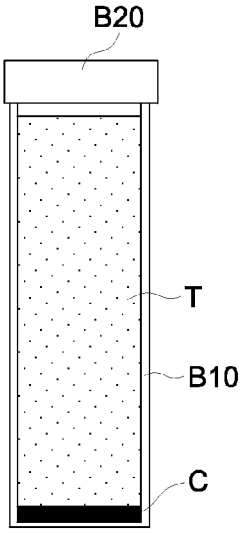

The third step is a step in which cap B20 is attached onto the opening of container main body B10 to prevent leakage of a replenisher developer in the container main body to the outside. FIG. 3*c* shows a situation of the inside of developer container B after conducting the third step. The carrier C layer is formed at the bottom inside developer container B, and the toner T layer is deposited thereon.

The fourth step is a step in which developer container B in the situation of FIG. 3*c* is put upside down through 180° rotation of developer container B by an operator, and developer container B thereof is placed on installation holder A12 of adjusting apparatus A. This step forms the toner T layer placed on the underside in developer container B, and forms the carrier C layer having larger specific gravity than that of toner T, on the upper side of toner T.

Figure 3D:
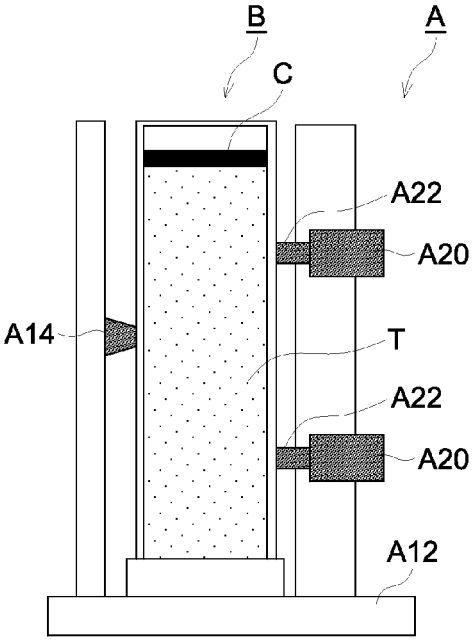

FIG. 3*d* shows a situation after conducting the fourth step. As shown in the figure, developer container B is sandwiched and supported with three members composed of two shaking members A22 and one pressing member A14, and placed on installation holder A12. As described above, it is stably supportable with shaking device A20 and pressing device A14. Thus, the supporting portion of adjusting apparatus A to support developer container B is composed of at least installation holder A12, shaking device A20 and pressing device A14.

Further, as shown in FIG. 3*d*, shaking member A22 presses the outer wall of developer container B corresponding to the region in which toner is deposited.

Figure 3E:
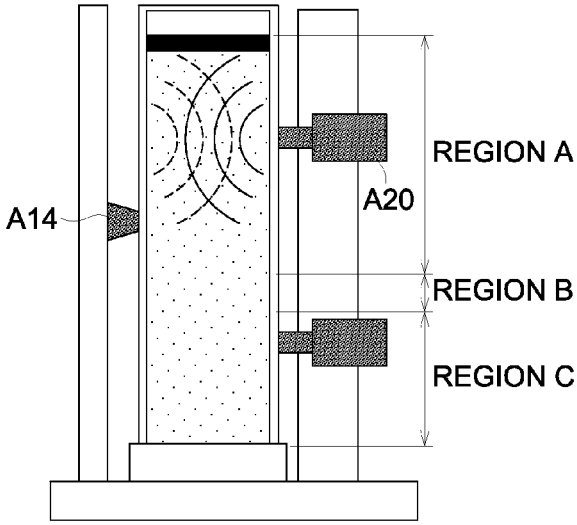

Next, a shaking step of the present invention in the fifth step will be described referring to FIG. 3*e*. The fifth step is a step in which only shaking device A20 placed on the upper side is operated, and a toner layer and a carrier layer placed on top of the toner layer are vibrated to mix the carrier into the toner layer via agitation.

When operating shaking device A20 on the upper side singly, shaking member A22 on the upper side vibrates the outer wall of developer container B in the direction perpendicular to the wall. Vibrational waves from shaking device A20 on the upper side pass through developer container B via a shaking member, and propagate a toner T layer deposited in developer container B. Further, they are reflected on the wall surface of developer container B on the opposite side, and propagated so as to come back to the shaking device A20 side. In FIG. 3*e*, waves released from shaking member A22 are shown in solid line, and waves reflected on the container wall are illustrated in dashed line.

For this reason, the toner layer region to which vibrations from shaking device A20 travels are exposed to vibrational waves, resulting in generation of an agitation state, and coagulated toners are broken down, whereby binding force of toner-to-toner is weaken. Carrier C present in the region of the above-described vibrational state (agitation state) is moved to the lower side in accordance with gravity at speed corresponding to the vibrational intensity. Since the uppermost portion of the toner deposition layer is also exposed to vibrational waves, carrier C sequentially enters from the carrier layer located above.

Through considerable effort during intensive studies, a carrier concentration distribution in the longitudinal direction of the inside of developer container B is determined by the following energy Ea output from shaking device A20.

$$Ea=(1/2)\cdot Pa^2\cdot Ta$$

where Ta means a shaking period during operation of shaking device 20A, and Pa means a pressure of compression air.

In other words, when pressure of compression air Pa remains constant, the carrier concentration distribution in the longitudinal direction of the inside of developer container B is changed depending on shaking period Ta. For example, in the uppermost portion of the toner layer region, there appears extremely high concentration at the initial stage, but it is gradually reduced, and ends up approaching asymptotically to zero. On the other hand, in regain Zb (shown in FIG. 12) being away from shaking member A22, and located on the lower side, in which vibrational waves are effectively weaken, the concentration having been zero at the initial stage ends up exhibiting the maximum carrier concentration in the vicinity of region Zb in developer container B, since carrier C falling from the upper region reaches at some point, and remains retained.

Figure 4:
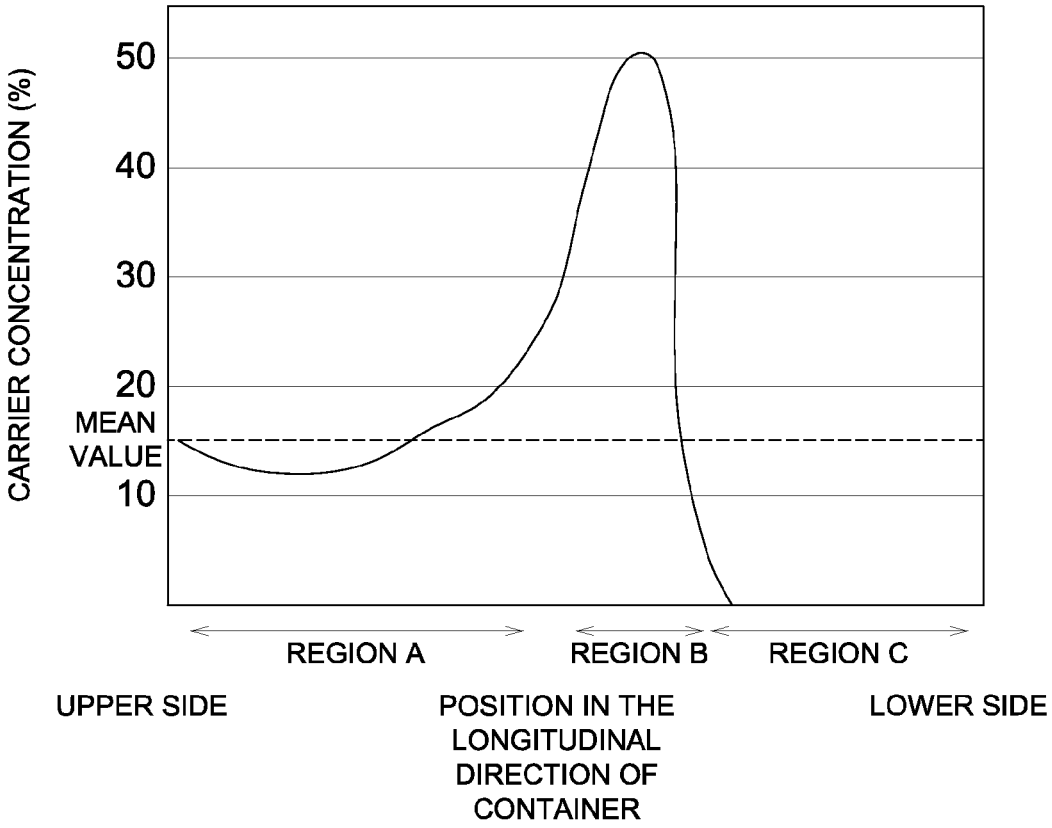
FIG. 4 is a diagram showing a carrier concentration distribution in developer container B for the developer adjusted in the first embodiment.

FIG. 4 is a diagram showing a carrier concentration distribution in developer container B for the developer adjusted in the first embodiment, and shows the case where operation of shaking device A20 is stopped at a time when the carrier concentration at the upper portion drops down to the mean value as described below. In addition, the dashed line in the figure indicates the mean value calculated by regarding the replenisher developer as one evenly ideally-mixed (15% by weight in this case).

When evaluating a replenisher developer adjusted in the first embodiment described above with respect to each region, the carrier concentration of the developer sampled from region A where vibrational energy is sufficiently reached indicates a value near the mean value. The developer sampled from region B indicates a high carrier concentration so as to produce malfunction in toner concentration detection as well as an image problem. The developer sampled from region C located lower than region B indicates a carrier concentration of 0% or nearly 0% thereof, and is one with which no trickle developing system works at all.

In addition, each of regions A, B and C described herein is distinguished by a state of the developer in the developer container at a time when shaking device A20 provided on the upper side of the developer container is singly operated, and is stopped at a certain time. Three levels of regions A, B and C are classified below.

Region A means a region in a state where vibrations are sufficiently given, whereby the carrier is dispersed.

Region B means a region in a state where the carrier streams down to the lower portion of the developer container, and remains not dispersed any more.

Region C means a region in a state where the carrier is not dispersed at all, and only toner is present.

Figure 7:
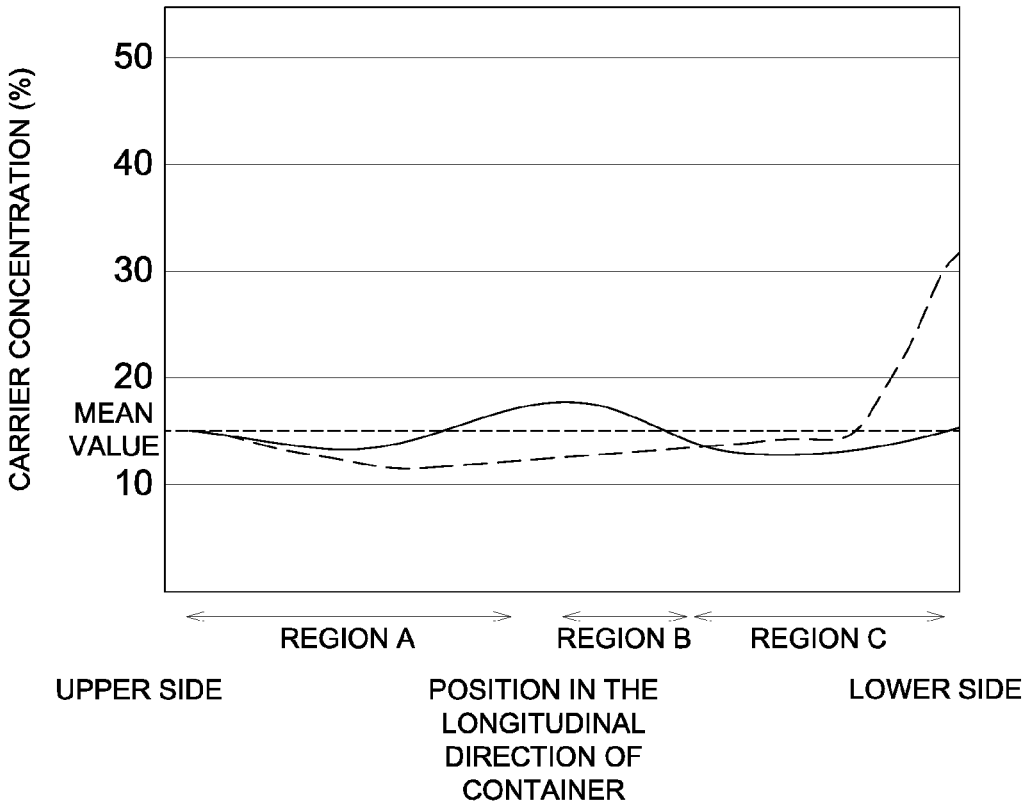
FIG. 7 is a diagram showing a carrier concentration distribution in developer container B for the developer adjusted in the second embodiment.

The present invention has intention of eliminating the difference between one region and another region concerning regions A, B and C having been originally problematic in toner-carrier unevenness, as shown in FIG. 7.

The above-described embodiment is an embodiment, in which a situation where vibrations of shaking device A20 insufficiently reach the entire region in the longitudinal direction of the container, is generated, but it can be confirmed that no toner aggregate is produced in the region that the above-described vibrations sufficiently reach sufficiently, and carrier C and toner are evenly mixed in carrier concentration nearly equal to the mean value. Further, it can be confirmed that no energy is desired to be applied in comparison to the case in conventional adjusting methods, and the method herein is an adjusting method carried out in a short period of time of 10 seconds or less.

On the other hand, in the region that the above-described vibrations insufficiently reach, there appears a problem such that incorporation of the carrier into a toner layer is not accelerated, whereby the carrier concentration becomes high, but it can be confirmed that the method is a feasible adjusting method, provided that designed is a situation where vibrations from a shaking member with sufficient intensity reach the entire region inside the container.

The Second Embodiment

The adjusting method in the present embodiment is one to solve the problem produced in the first embodiment described above, and also to improve the fifth step in the first embodiment.

FIG. 5 is a general outline diagram showing a principle of improvement to the adjusting method in the second embodiment. The major improvement point is that shaking devices located above and below are designed to be operated in such a way that vibrations from the shaking member reach the entire region in the longitudinal direction of developer container B.

Figure 5A:
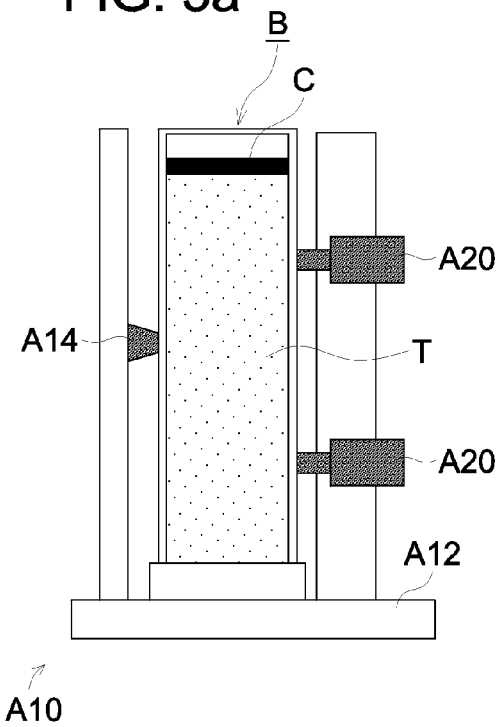
FIGS. 5(*a*)-5(*c*) each are a general outline diagram showing an adjusting method and an adjusting apparatus in the second embodiment.

FIG. 5*a* shows a situation after the fourth step in the first embodiment described above has been conducted.

As shown in FIG. 5*a*, developer container B is placed on installation holder A12 of an adjusting apparatus main body by an operator, and nipped with three devices composed of two shaking devices A20 located above and below, and one pressing device A14 to support it.

Figure 5B:
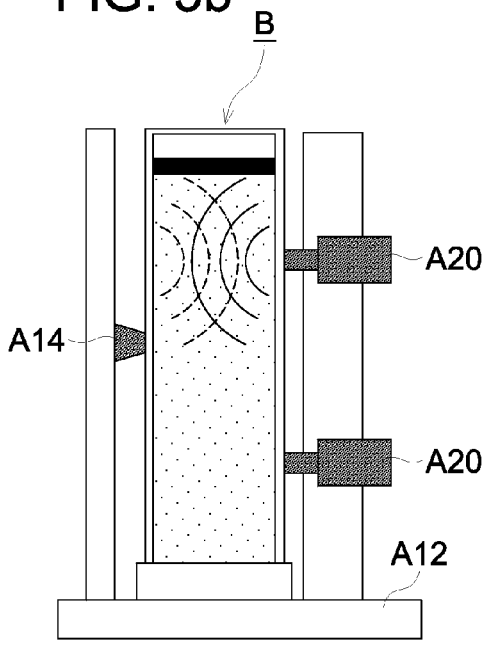
Figure 5C:
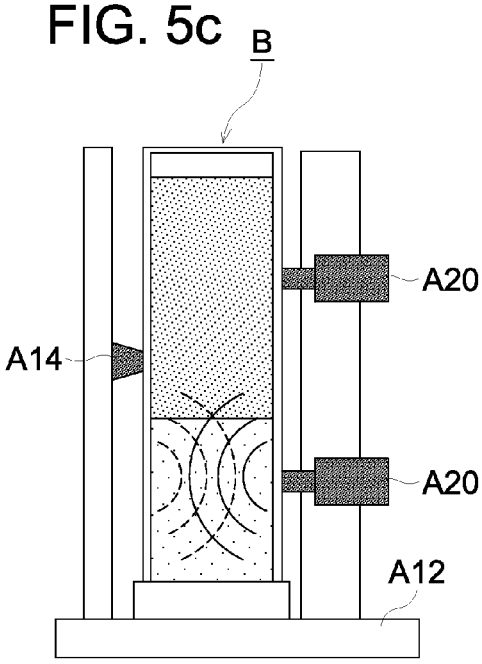

Next, the fifth step, by which two shaking devices A20 of the present invention are operated to mix a carrier in a toner layer inside developer container B, will be described referring to FIG. 5*b* and FIG. 5*c*.

This step possesses the first shaking step to vibrate shaking device A20 located above, and the second shaking step to vibrate shaking device A20 located below.

In the case of both the shaking steps, a mixing behavior by which carrier C moves in a toner layer is the same one as described in the first embodiment, and is omitted. Specifically, the first shaking step is the same as the fifth step in the first embodiment, and operation of shaking device A20 located above is stopped at a time when the carrier concentration in the upper portion region drops down nearly to the intended value.

After terminating the first shaking step, operation of the second shaking step is started. Further, shaking device A20 located below is provided in such a way that vibrations of shaking device A20 reach the region from region B to developer container B.

Operation of shaking device A20 located below is stopped at a time when the carrier concentration in a developer contained in the lowermost layer inside developer container B presumably reaches the intended value to stop the second shaking step.

Figure 6:
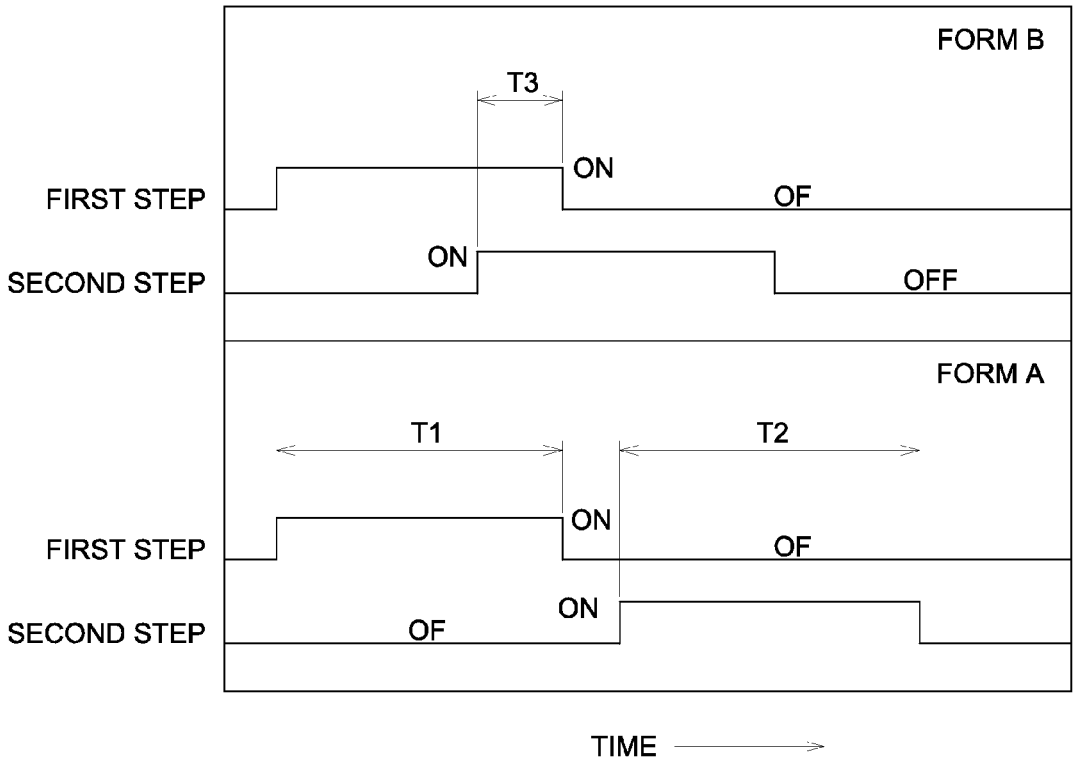
FIG. 6 is a timing chart showing start-up timing in the first shaking stroke and in the second shaking stroke.

FIG. 6 shows a timing-sequence of first shaking period T1 as a shaking period in the first shaking step, and second shaking period T2 as a shaking period in the second shaking step. The transverse axis indicates time, and first shaking period T1 (ON) and second shaking period T2 (ON) are seen. Form A on the lower side shows a timing-sequence of both shaking periods T1 and T2 in the second embodiment as described above. Each of shaking periods T1 and T2 is appropriately arranged to be selected in such a way that the carrier concentration distribution of a replenisher developer inside developer container B falls within the suitable range.

It is also possible to overlap each of the start-up periods as shown in Form B on the upper side. Reduction of the adjusting time is advantageous, but in order to adjust a carrier concentration distribution of the replenisher developer inside developer container B to fall within the suitable range, overlapping period T3 other than each of shaking periods T1 and T2 is also desired to be optimized, whereby conditioning to be optimized becomes complicated.

In any case, in order to adjust a carrier concentration distribution in the container longitudinal direction to fall within a narrow range, it is desired that not only vibrations are applied to the toner in the entire region inside the container by shaking a plurality of shaking members, but also "the second shaking step on the lower side is operated after completing operation of the first shaking step on the upper side", or "the second shaking step on the lower side is operated after operating at least the first shaking step on the upper side".

FIG. 7 is a diagram showing a carrier concentration distribution in developer container B for the developer adjusted in the second embodiment. The transverse axis indicates the position in the longitudinal direction of the container, and the left side means the upper side of developer container B and the right side means the lower side of it. The vertical axis indicates carrier concentration of a replenisher developer.

In addition, the solid line indicates the carrier concentration distribution in the case of operation with a timing-sequence in Form A described above, and means evenly mixing in the practically obstruction-free concentration range (deviation) mainly including the mean value. The dashed line indicates the carrier concentration distribution in the case of operation with a timing-sequence by which second shaking period T2 and first shaking period T1 are synchronously overlapped. In this case, deviation of the carrier concentration in the container longitudinal direction becomes large, whereby found is a timing-sequence which is poor in view of evenness of the carrier concentration distribution.

Further, in order to adjust a carrier concentration distribution in the container longitudinal direction to fall within a narrower range, it is effective that the number of shaking devices is increased, or the location of each shaking device is appropriately adjusted for the developer container. Further, since it is confirmed that propagation of vibrations can be adjusted by varying area and hardness of the tip of shaking member A22, it is also effective that the area and hardness of the tip of the shaking member are appropriately selected.

The Third Embodiment

Figure 8:
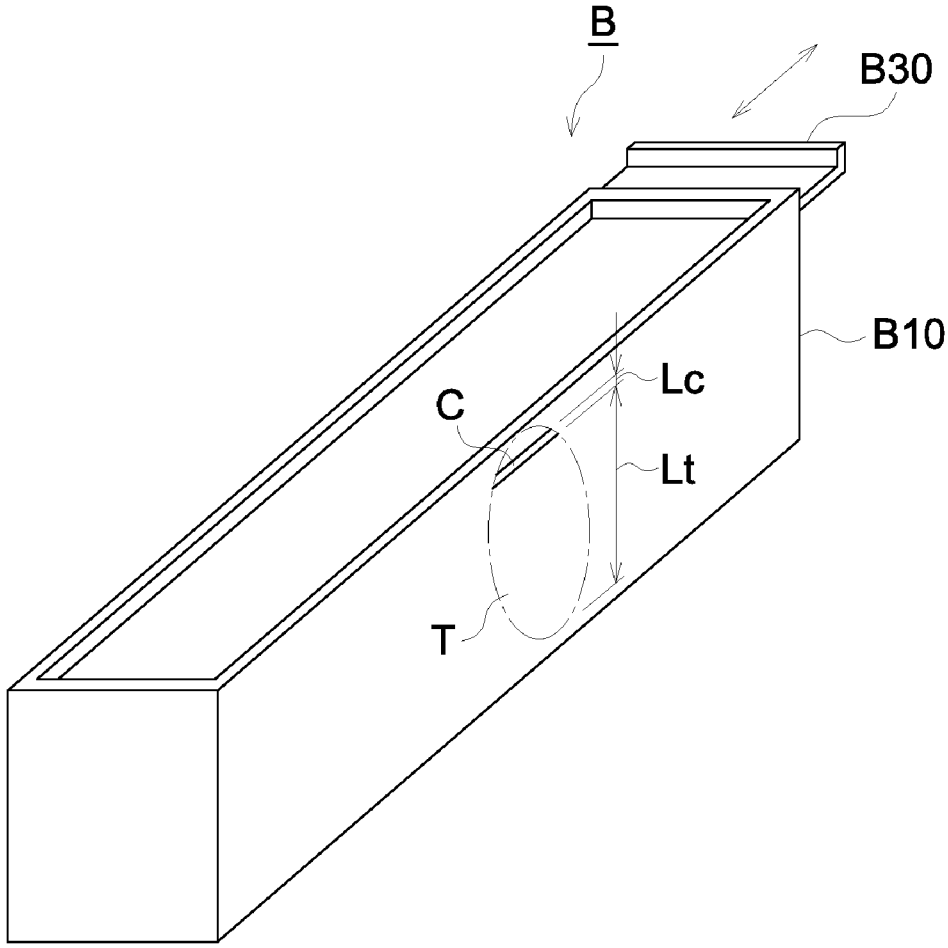
FIG. 8 is an appearance perspective view showing developer container B in the third embodiment.

FIG. 8 is an appearance perspective view showing a different type of developer container B in the third embodiment of the present invention.

As shown in the figure, developer container B is equipped with parallelpipedon-shaped container main box B10 and open-close lid B30 to open or close an opening of container main body B10.

The opening of container main body B10 possesses unshown grooves to guide open-close lid B30, and open-close lid B30 is one to open or close the opening of container main body B10 by sliding the grooves as shown by the arrow.

An operator provides a predetermined amount of toner T in container main body B10 in so as to make the upper surface of toner T to be horizontal, and further, a predetermined amount of carrier C is uniformly placed on top of the toner T layer. Next, open-close lid B30 is firmly fitted with container main body B10, and developer container B is placed horizontally to holder A11 (FIGS. 9*a* and 9*b*) of adjusting apparatus main body A10 in the situation where the carrier layer is placed on top of the toner layer.

The inside of a dashed-dotted line shown in the figure shows a perspective diagram of seeing through a part of the front of container main body B10 placed on holder A11, and shows toner T layer Lt and carrier C later Lc filled in container main body B10.

Figure 9A:
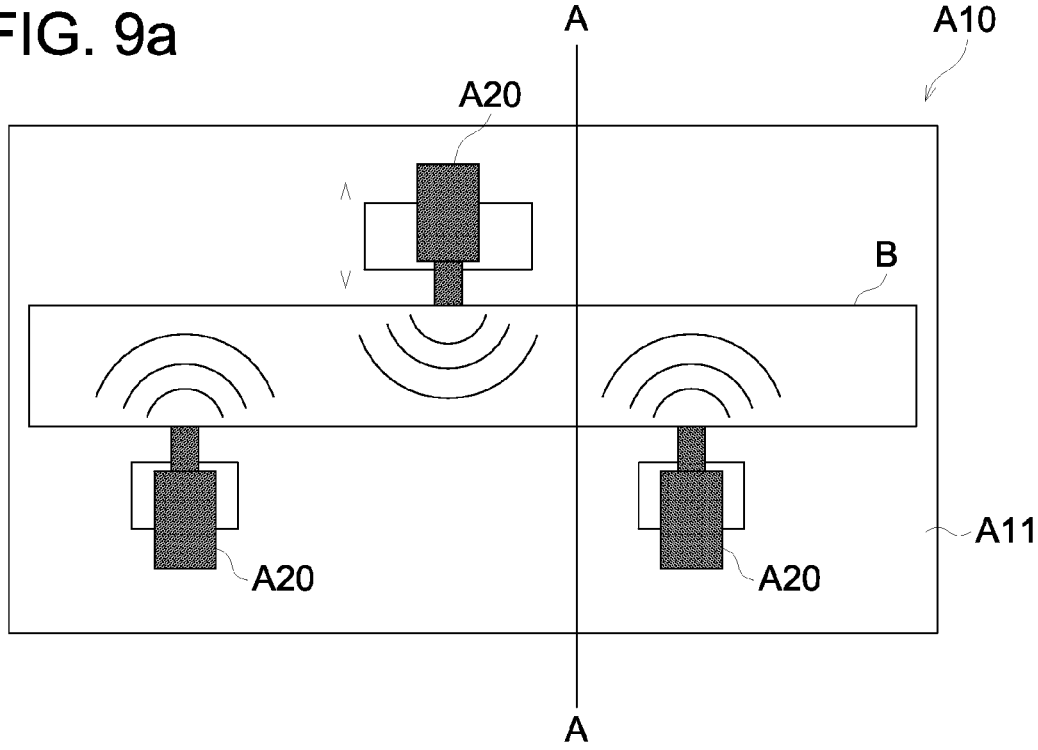
FIGS. 9(*a*)-9(*b*) each are a general outline diagram showing an adjusting method and an adjusting apparatus in the third embodiment.
Figure 9B:
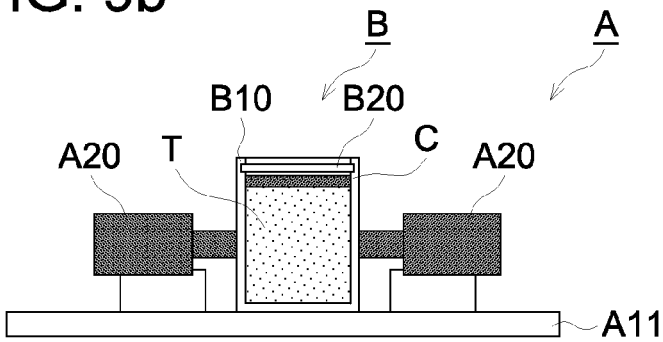

FIG. 9*a* shows a top view of adjusting apparatus main body A10 in which developer container B shown in FIG. 8 is placed on holder A11. FIG. 9*b* shows an AA cross-sectional view of FIG. 9*a*.

Developer container B placed on holder A11 as shown in the figure is nipped with three shaking devices A20 to support it. Two shaking devices A20 provided on one side of developer container B are secured to holder A11 of adjusting apparatus main body A10. One shaking device A20 placed on another side is movable as shown by an arrow, and developer container B is pressed to two shaking devices described above with the predetermined pressing force via operator's operation.

When stat-up operation is conducted by an operator in the situation where developer container B as shown above is nipped with three shaking devices A20 to support it, each of three shaking devices A20 applies a predetermined amount of energy to the predetermined part of developer container B.

In the third embodiment, there is no effect from operating timing of each shaking device A20, since each shaking device has no upper or lower position relationship. Accordingly, each the position of shaking device A20 is desired to be optimized in such a way that vibrational energy at a time when the replenisher developer inside developer container B exhibits the same in height becomes even. Further, applied vibrational energy (shaking period when air pressure Pa of piston vibrator A21 remains constant) is desired to be optimized. Practically, in consideration of two items described above, the adjustment should be made in accordance with developer container B.

[Actual Machine Evaluation of Replenisher Developer Prepared by Adjusting Apparatus Described Above]

Figure 10:
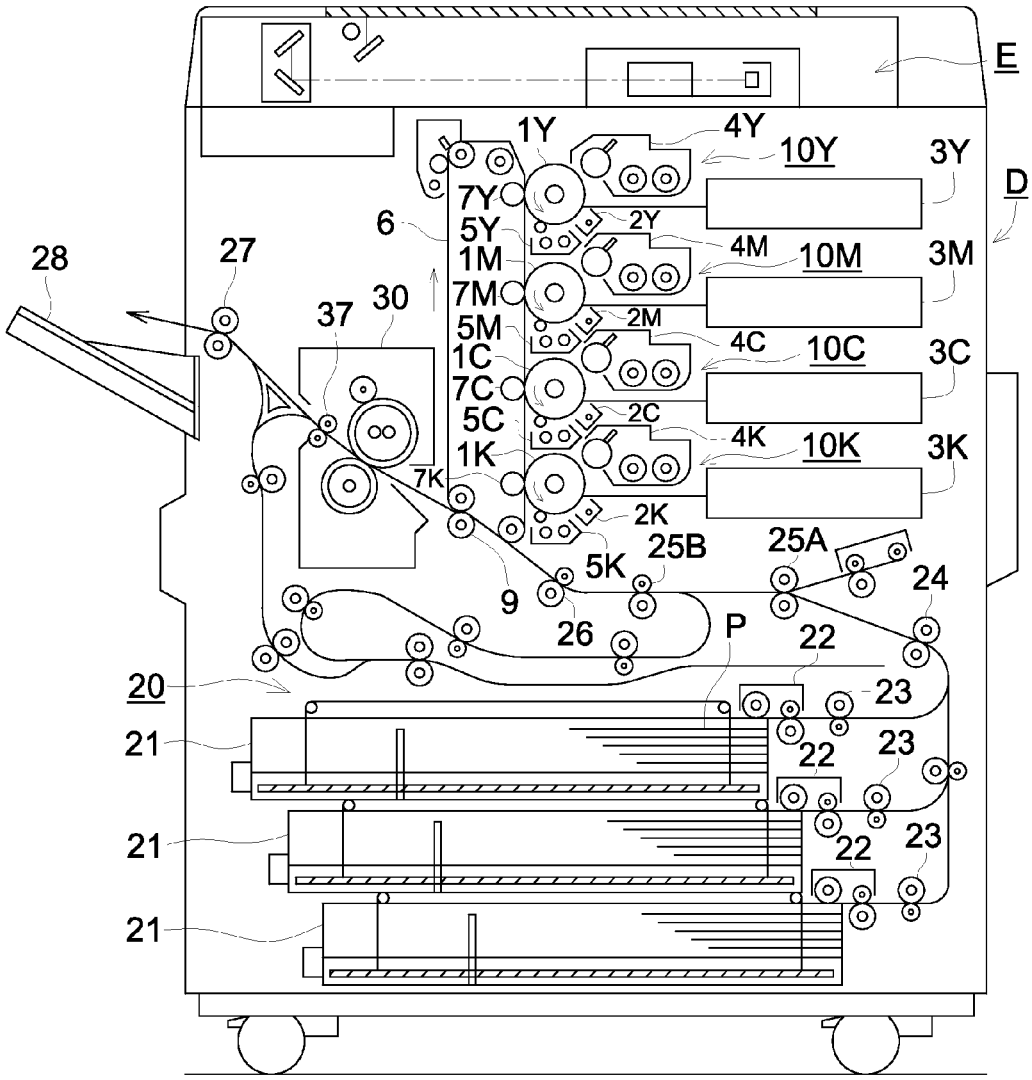
FIG. 10 shows a center cross-sectional diagram of image forming apparatus D employed for an actual machine evaluation test of a replenisher developer adjusted by the adjusting method and the adjusting apparatus of the present invention.

FIG. 10 shows a center cross-sectional diagram of an image forming apparatus to conduct an actual machine evaluation test of a replenisher developer adjusted by an adjusting apparatus of the present invention (the second embodiment), and of replenisher developer B in which the replenisher developer is stored.

[Image Forming Apparatus for Evaluation]

Image forming apparatus D is one called a tandem type color image forming apparatus, and is equipped with a plurality of image forming sections 10Y, 10M, 10C and 10K, belt-shaped intermediate transfer member 6, paper feeding device 20, after-mentioned fixing section 30 and so forth.

Image reading apparatus E is placed on the upper part of image forming apparatus D. The manuscript placed on a manuscript holder is image-scanning-exposed to light emitted by an optical system of a manuscript image-scanning exposure device in image reading apparatus E to read the image in a line image sensor. Analog signals photoelectrically converted by the line image sensor are input to light exposure devices 3Y, 3M, 3C and 3K, after conducting analog processing, A/D conversion, a shading correction and image compression processing in an image processing section.

Image forming section 10Y to form an image in yellow (Y) color has therein charging device 2Y, light exposure device 3Y, developing device 4Y and cleaning device 5Y which are placed around photoreceptor drum 1Y as an image carrier. Image forming section 10M to form an image in magenta (M) color has therein photoreceptor drum 1M as an image carrier, charging device 2M, light exposure device 3M, developing device 4M and cleaning device 5M. Image forming section 10C to form an image in cyan (C) color has therein photoreceptor drum 1C as an image carrier, charging device 2C, light exposure device 3C, developing device 4C and cleaning device 5C. Image forming section 10K to form an image in black (K) color has therein photoreceptor drum 1K as an image carrier, charging device 2K, light exposure device 3K, developing device 4K and cleaning device 5K. Charging device 2Y and light exposure device 3Y constitute a latent image forming device; charging device 2M and light exposure device 3M constitute a latent image forming device; charging device 2C and light exposure device 3C constitute a latent image forming device; and charging device 2K and light exposure device 3K also constitute a latent image forming device.

Symbol 4Y represents a developing device to store a two-component developer composed of a carrier and a yellow (Y) toner having a small particle diameter; symbol 4M represents a developing device to store a two-component developer composed of a carrier and a magenta (M) toner having a small particle diameter; symbol 4C represents a developing device to store a two-component developer composed of a carrier and a cyan (C) toner having a small particle diameter; and symbol 4K also represents a developing device to store a two-component developer composed of a carrier and a black (K) toner having a small particle diameter.

Each of developing devices 4Y, 4M, 4C and 4K for each color has a structure (not shown in the figure) in which developer container B to store a replenisher developer adjusted by adjusting apparatus A of the present invention is attached onto a toner replenishing section thereof, and is a so-called trickle developing system developing device.

A transfer section possesses intermediate transfer member 6 supported in such a way that the intermediate transfer member is wound and rotatable with a plurality of rollers, a primary transfer section equipped with primary transfer devices 7Y, 7M, 7C and 7K, and a secondary transfer section equipped with secondary transfer roller 9.

An image of each color having been formed with image forming section 10Y, 10M, 10C or 10K is sequentially transferred onto rotatable intermediate transfer member 6 by each of primary transfer devices 7Y, 7M, 7C and 7K to form a synthesized color image.

Recording medium P (hereinafter, referred to as sheet) stored in sheet storing section 20 (sheet feeding cassette) of sheet feeding device 20 is fed by sheet feeding device 22 (the first sheet feeding section), and is conveyed to secondary transfer device 9 (transfer roller) in the secondary transfer section via sheet feeding rollers 23, 24, 25A and 25B, and registration roller 26 (the second sheet feeding section) to transfer a color image onto sheet P.

Sheet P onto which a color image has been transferred is conveyed to fixing section 30. Then, action of heat and pressure is applied, and a color toner image (or a toner image) on the sheet is fixed on sheet P.

Sheet P having been subjected to a fixing treatment is nipped with a pair of rollers 37 for conveyance; is ejected outside from sheet ejecting roller 27 provided along the ejecting sheet path; and is placed on ejecting paper tray 28 provided outside.

[Evaluation Method of Replenisher Developer]

The evaluation method (procedures) of a replenisher developer for trickle developing, which is adjusted employing an adjusting apparatus in the second embodiment, will be described below.

Procedure 1: Developer container B for evaluation in which a replenisher developer for evaluation is stored is adjusted employing an adjusting apparatus in the second embodiment (timing-sequence in Form A) by varying first shaking period T1 of the first shaking step and second shaking period T2 of the second shaking step.

Procedure 2: Samples each having an appropriate amount of a replenisher developer were collected from 100 portions inside developer container B for evaluation, and carrier concentration of each sample was evaluated to determine carrier concentration variations (average concentration and concentration deviation) of the replenisher developer stored in developer container B.

Procedure 3: Developer container B for evaluation, whose examination was completed in Procedure 2, was actually installed in image forming apparatus D to conduct a practical picture test.

Figure 11:
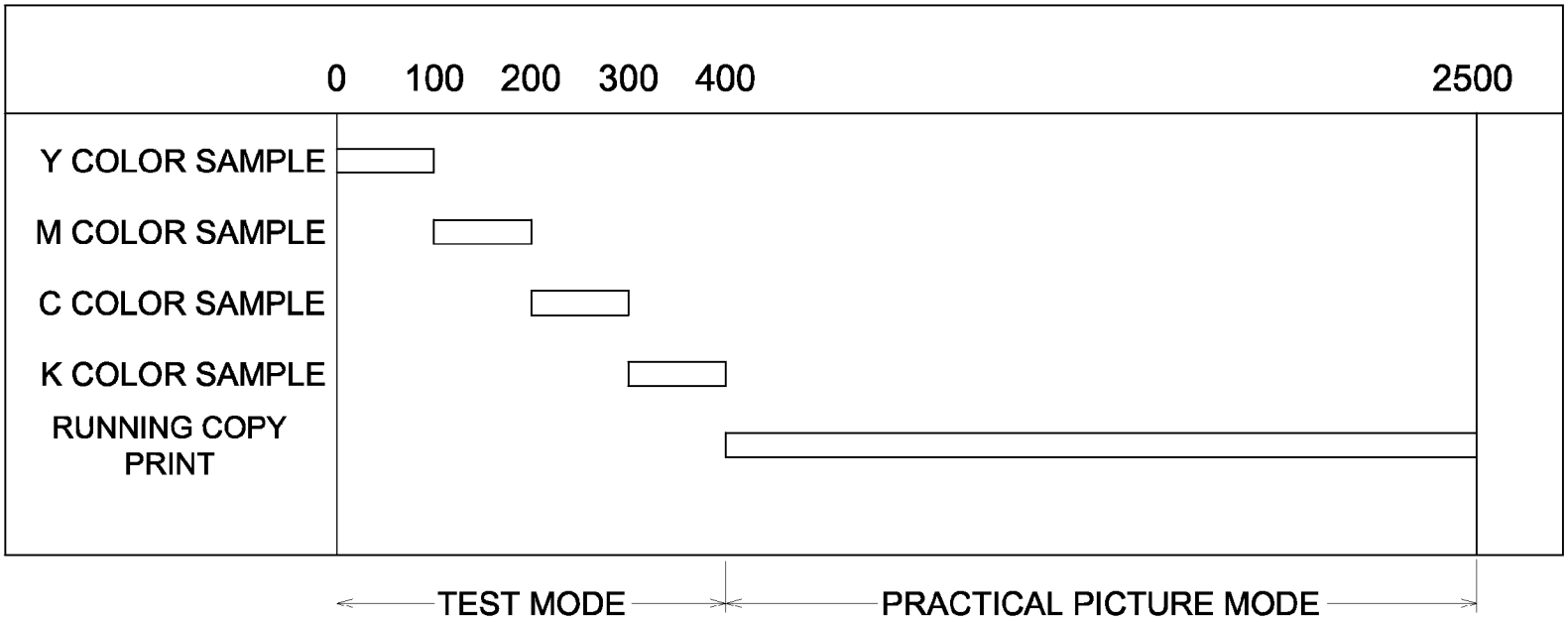
FIG. 11 shows a timetable for an operating plan of a practical picture test.

FIG. 11 shows a timetable for an operating plan of a practical picture test.

The evaluation test is carried out with a practical picture mode as well as a test mode. Both modes are repeated every 2500 print sheets, and print sheets are printed as the total number of print sheets.

The above-described evaluation test applies each developer container B for evaluation, which is adjusted by varying first shaking period T1 and second shaking period T2.

The practical picture mode proceeds by continuously printing running copy images composed of each color image having a mean print ratio of 3%, in full color image formation mode.

The test mode is one to continuously print 100 test images in monochromatic mode for each of Y color, M color, C color and K color.

Figure 12:
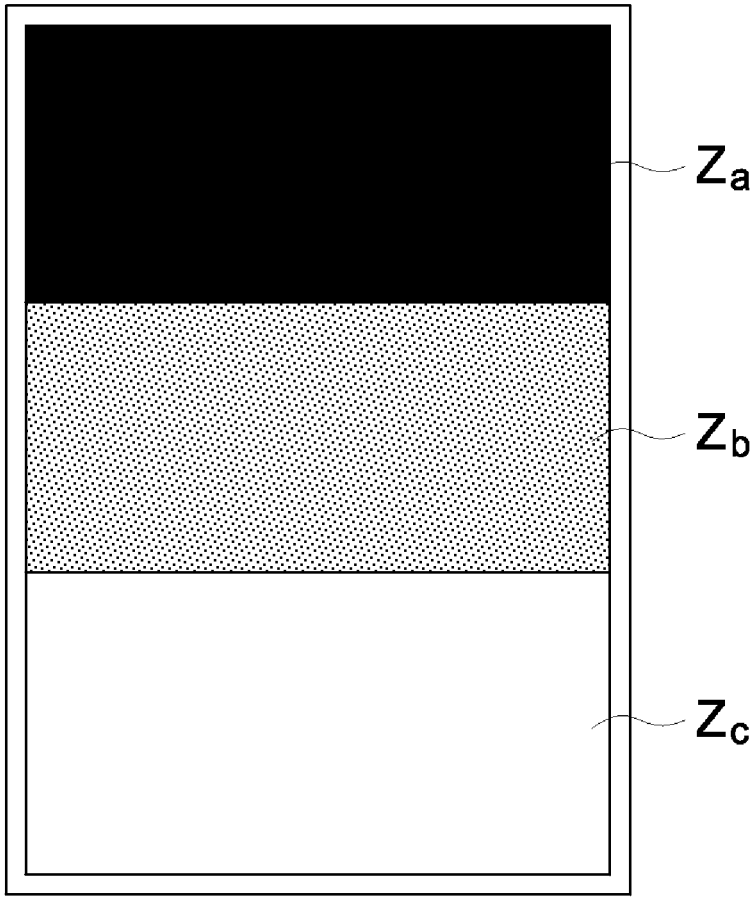
FIG. 12 shows a layout chart of a test image.

FIG. 12 shows a layout chart of a test image. Region Za in the figure is a solid image region with a printing ratio of 100%; region Zb is a halftone image region with a print ratio of 50%; and region Zb is a region where no image having a print ratio of 0% is formed. Accordingly, the test image is one equivalent to an image having a mean print ratio of 50%.

Taking into consideration that running copy images printed for test proceeding have a mean print ratio of 3%, there appears a situation where a large amount of the replenisher developer is supplied into each developing device installed in image forming apparatus D, since a large amount of toner is consumed during the test mode. Since test images are output in such the situation, properties of replenisher developer are largely changed during the test mode, and reflected as image defects.

For example, degradation prevention of performance of toner supply into a photoreceptor (referred to commonly as solid development) as the principal effect of a trickle developing system is reflected as a process of image density thereof in region Za.

Image defects caused by supplying a replenisher developer with a high concentration carrier into a developing device are reflected as "image density unevenness" in region Zb.

Image defects caused by toner aggregates mixed in the replenisher developer are reflected as "fog" in region Zc Carrier adhesion is determined by touching the image sample surface.

[Evaluation Results of Developers Adjusted by Adjusting Method of the Present Invention]

TABLE 1

| | Shaking conditions (sec) | | Carrier concentration (% by weight) | | Image evaluation | | | Developer life |
|---|---|---|---|---|---|---|---|---|
| Test | T1 | T2 | Mean value | Deviation | Image roughness | Density unevenness | Fog | Density drop |
| Ex. 1 | 3 | 5 | 5 | 10 | B | 0.05 | 0.006 | 35 |
| Ex. 2 | 5 | 5 | 10 | 5 | A | 0.02 | 0.004 | >50 |
| Ex. 3 | 5 | 5 | 15 | 6 | A | 0.02 | 0.005 | >50 |
| Ex. 4 | 5 | 6 | 20 | 5 | A | 0.03 | 0.004 | >50 |
| Ex. 5 | 5 | 5 | 30 | 10 | B | 0.05 | 0.007 | >50 |

TABLE 1-continued

| Test | Shaking conditions (sec) T1 | T2 | Carrier concentration (% by weight) Mean value | Deviation | Image evaluation Image roughness | Density unevenness | Fog | Developer life Density drop |
|---|---|---|---|---|---|---|---|---|
| Comp. 1 | 5 | 5 | 35 | 5 | B | 0.2 | 0.011 | 15 |
| Comp. 2 | 5 | 3 | 35 | 10 | C | 0.25 | 0.015 | 12 |
| Comp. 3 | 4 | 4 | 3 | 10 | C | 0.05 | 0.022 | 10 |
| Comp. 4 | 3 | 3 | 5 | 12 | C | 0.05 | 0.025 | 11 |
| Comp. 5 | 3 | 4 | 40 | 15 | C | 0.45 | 0.055 | 20 |

Ex.: Example
Comp.: Comparative example

Table 1 shows a list of evaluation results of the replenisher developer inside developer container B, adjusted by an adjusting method of the present invention. Also shown are evaluation results obtained via a practical picture test of 500,000 print sheets employing trickle developing system image forming apparatus D by using the mean carrier concentration and carrier concentration deviation as parameters as to the replenisher developer inside developer container B. The mean carrier concentration is indicated by % by weight of carrier, based on the total developer containing the toner and the carrier.

The replenisher developer for evaluation was adjusted by adjusting apparatus A in FIG. 5 in such a manner that the mean carrier concentration falls within the range of 5-40% by weight. "Mean value" in the carrier concentration space shown in Table 1 corresponds to the mean carrier concentration.

Further, replenisher developers for evaluation, each having a different deviation of carrier concentration with respect to the replenisher developer stored inside developer container B were adjusted by varying each shaking condition (T1, T2) of adjusting apparatus A. "Deviation" in the carrier concentration space is expressed as the difference between the maximum value and the minimum value among carrier concentration values obtained by measuring 100 developers sampled from developer container B, which is divided by 2.

when developer container B shown in FIG. 1 is installed in image forming apparatus D, and is rotated in the W1 direction shown in FIG. 1, the carrier concentration distribution in the inside of developer container B directly reflects carrier concentration of a replenisher developer supplied to a developing device from an opening of cap B20 for developer container B. Accordingly, the fluctuation range of carrier concentration of a replenisher developer supplied into an image forming apparatus corresponds to "deviation" in the carrier concentration space.

Next, evaluation results obtained via the practical picture test will be described below, referring to Table 1.

The number of print sheets at the initial stage when solid density of the sample is dropped to 1.2 or less is filled in the space of "Developer life" in Table 1, and the unit is "ten thousand print sheets".

The image evaluation shown in Table 1 is conducted at the time of the 100 thousandth print sheet.

With respect to the evaluation of density unevenness, the density measurement was conducted at 8 portions in image region Za, and the difference between the maximum value and the minimum value was designated as density unevenness. A density unevenness of less than 0.2 is not problematic, but a density unevenness of less than 0.05 is preferable. In the image roughness evaluation, presence or absence of image roughness was visually observed in region Zb. "A" indicates no image roughness observed at all; "B" indicates image roughness at no problematic level; and "C" indicates image roughness at a problematic level. In the fog evaluation, image density was evaluated at the white paper portion in region Zc. A fog of less than 0.01 is not practically problematic, but a fog of 0.005 or less is preferable.

As shown in Table 1, it was confirmed that "density unevenness" in the image evaluation as a previously-existing problem was possible to be solved by employing an adjusting apparatus of the present invention.

Further, it became possible to provide a trickle developing replenisher developer capable of outputting high quality images over a long period of time, and to provide a trickle developing system image forming apparatus exhibiting excellent image stability and developer durability via replenishment of the replenisher developer, and a replenisher developer cartridge for the trickle developing system image forming apparatus by adjusting carrier concentration deviation of the replenisher developer employing an adjusting apparatus of the present invention so as to fall within the range of 10% or less.

It became also possible to provide a trickle developing replenisher developer capable of outputting high quality images over a long period of time by appropriately adjusting the shaking condition of the adjusting apparatus of the present invention. It is possible to provide a trickle developing system image forming apparatus exhibiting excellent image stability and developer durability.

In addition, in the case of the above-described embodiment of the present invention, the developer container is used as a container of the present invention, but the container of the present invention is not limited thereto, and includes large-scale equipment capable of adjusting the trickle developing replenisher developer filled in the developer container in the post-step continuously or in large amounts.

Further, in the second embodiment of the present invention, a plurality of shaking devices are located above and below, but a shaking device may be vibrated in the different timing after moving the shaking device to each of the positions.

In the second embodiment of the present invention, the relay action is performed between the first step and the second step, and the adjustment can be designed to be completed in a shaking period of 10 seconds in total, but the shaking period can be reduced to a few minutes by increasing the shaking intensity generated by each shaking device. Furthermore, a small installation area is good enough for an adjusting apparatus of the present invention which is suitable as one in compact installation.

A series of experimental results were summarized in those described below by organizing them.

(1) When a replenisher developer possessing at least a carrier and a toner is designed to have a carrier concentration of 5-30% by weight, and a concentration deviation of the carrier in the replenisher developer is set to 10% by weight or less, it is possible to provide a trickle developing replenisher developer exhibiting excellent developer durability to solve the problem described in the present invention.

(2) When a replenisher developer possessing at least a carrier and a toner is designed to have a carrier concentration of 5-20% by weight, and a concentration deviation of the carrier in the replenisher developer is set to 10% by weight or less, it is possible to provide a trickle developing replenisher developer exhibiting excellent image stability and developer durability to solve the problem described in the present invention.

(3) When a replenisher developer possessing at least a carrier and a toner, which is stored in a developer container, is designed to have a carrier concentration of 5-30% by weight, and a concentration deviation of the carrier in the replenisher developer is set to 10% by weight or less, it is possible to provide a trickle developing developer container exhibiting excellent developer durability to solve the problem described in the present invention.

(4) When a replenisher developer possessing at least a carrier and a toner, which is stored in a developer container, is designed to have a carrier concentration of 5-20% by weight, and a concentration deviation of the carrier in the replenisher developer is set to 10% by weight or less, it is possible to provide a trickle developing developer container exhibiting excellent image stability and developer durability to solve the problem described in the present invention.

(5) When a replenisher developer possessing at least a carrier and a toner, which is supplied for a long duration, is designed to have a carrier concentration of 5-30% by weight in terms of mean value, and a concentration deviation of the carrier in the replenisher developer is set to 10% by weight or less to replenish an image forming apparatus with the replenisher developer, it is possible to provide a trickle developing system image forming apparatus exhibiting excellent image stability and developer durability to solve the problem described in the present invention.

(6) When a replenisher developer possessing at least a carrier and a toner, which is supplied for a long duration, is designed to have a carrier concentration of 5-20% by weight in terms of mean value, and a concentration deviation of the carrier in the replenisher developer is set to 10% by weight or less to replenish an image forming apparatus with the replenisher developer, it is possible to provide a trickle developing system image forming apparatus exhibiting excellent image stability and developer durability to solve the problem of the present invention.

EFFECT OF THE INVENTION

The present invention is possible to provide a replenisher developer cartridge for an image forming apparatus to stably output high quality images, and to improve durability of a two-component developer used in the image forming apparatus.

What is claimed is:

1. A replenisher developer cartridge to replenish an image forming apparatus comprising a two-component developing device with a replenisher developer comprising a toner and a carrier, stored in a developer container, wherein the carrier in the replenisher developer has a concentration of 5-30% by weight in terms of mean value, and a concentration deviation of the carrier in the replenisher developer is 10% by weight or less.

2. The replenisher developer cartridge of claim 1, wherein the carrier in the replenisher developer has a concentration of 5-20% by weight in terms of mean value.

3. The replenisher developer cartridge of claim 1, wherein the replenisher developer cartridge is capable of being put on the image forming apparatus when developing is conducted.

4. The replenisher developer cartridge of claim 1, wherein the replenisher developer cartridge is adjusted by filling the toner and the carrier in the developer container so as to place a carrier layer on top of a toner layer and, shaking the developer container by vibrational energy.

5. The replenisher developer cartridge of claim 4, wherein the vibrational energy is applied to the developer container by contacting a shaking device on an outer wall surface of the developer container and operating the shaking device in order to vibrate itself.

6. The replenisher developer cartridge of claim 4, wherein the vibrational energy is applied to the developer container by contacting at least a first shaking device and a second shaking device on an outer wall surface of the developer container in a direction where the toner layer and the carrier layer are piled up in the developer container, wherein the first shaking device is placed on the carrier layer side and the second shaking device is placed on the toner layer side, and the second shaking device is operated after operating the first shaking device.

7. The replenisher developer cartridge of claim 6, wherein the second shaking device is operated after completion of the operating the first shaking device.

8. A method of adjusting a replenisher developer cartridge, the replenisher developer cartridge being for replenishing to an image forming apparatus having a two-component developing device with a replenisher developer stored in a developer container comprising a toner and a carrier, and the method comprising the steps of, filling the toner and the carrier in the developer container so as to place a carrier layer on top of a toner layer and, shaking the developer container by vibrational energy.

9. The method of adjusting a replenisher developer cartridge of claim 8, wherein the vibrational energy is applied to the developer container by contacting a shaking device on an outer wall surface of the developer container and operating the shaking device in order to vibrate itself.

10. The method of adjusting a replenisher developer cartridge of claim 9, wherein the vibrational energy is applied to the developer container by contacting at least a first shaking device and a second shaking device on an outer wall surface of the developer container in a direction where the toner layer and the carrier layer are piled up in the developer container, wherein the first shaking device is placed on the carrier layer side and the second shaking device is placed on the toner layer side, and the second shaking device is operated after operating the first shaking device.

11. The method of adjusting a replenisher developer cartridge of claim 10, wherein the second shaking device is operated after completion of the operating the first shaking device.

* * * * *